US005690039A

United States Patent [19]

Monro et al.

[11] Patent Number: 5,690,039

[45] Date of Patent: Nov. 25, 1997

[54] METHOD AND APPARATUS FOR REDUCING NITROGEN OXIDES USING SPATIALLY SELECTIVE COOLING

[75] Inventors: Richard J. Monro, Ridgefield; Peter D. Marx, Bethel, both of Conn.

[73] Assignee: RJM Corporation, Ridgefield, Conn.

[21] Appl. No.: 664,679

[22] Filed: Jun. 17, 1996

[51] Int. Cl.[6] ..... F23D 1/02; F23J 15/02

[52] U.S. Cl. ..... 110/264; 110/345; 431/5; 431/8

[58] Field of Search ..... 110/261, 262, 110/263, 264, 265, 345; 431/5, 8, 11

[56] References Cited

U.S. PATENT DOCUMENTS

| | | | |
|---|---|---|---|
| 3,873,671 | 3/1975 | Reed et al. | 423/235 |
| 3,957,420 | 5/1976 | Asai et al. | 431/175 |
| 4,089,639 | 5/1978 | Reed et al. | 431/5 |
| 4,699,071 | 10/1987 | Vier et al. | 110/345 |
| 4,989,549 | 2/1991 | Korenberg | 122/149 |
| 5,029,557 | 7/1991 | Korenberg | 110/264 |
| 5,040,470 | 8/1991 | Lofton et al. | 110/234 |
| 5,067,419 | 11/1991 | Kobayashi et al. | 110/234 |
| 5,237,939 | 8/1993 | Spokoyny et al. | 110/345 |
| 5,259,342 | 11/1993 | Brady et al. | 110/234 |
| 5,333,574 | 8/1994 | Brady et al. | 110/264 |
| 5,403,181 | 4/1995 | Tanaka et al. | 431/8 |
| 5,410,989 | 5/1995 | Kendall et al. | 122/367.1 |
| 5,433,174 | 7/1995 | Brady et al. | 110/345 |

*Primary Examiner*—Henry A. Bennett
*Assistant Examiner*—Gregory Wilson
*Attorney, Agent, or Firm*—St. Onge Steward Johnston & Reens

[57] ABSTRACT

A method and apparatus are described for reducing $NO_x$ in a combustion zone such as a boiler by spatially selectively injecting a cooling fluid into the combustion zone so that the fluid is entrained to intersect an identifiable $NO_x$ producing zone. The cooling fluid can be water or a gas or mixture of them and whose temperature is sufficiently low or whose combined mass flow and temperature are sufficiently low so that the cooling fluid can reach the $NO_x$ producing zone and cool it to a temperature where the $NO_x$ production is significantly reduced. In one embodiment of the invention a cyclone boiler has a number of identifiable $NO_x$ producing zones. Several of these are targeted by spatially distinct cooling fluid streams placed at strategic locations. At one location the cooling fluid such as a water spray is placed in a duct in the path of the secondary air to deliver a cooling secondary air stream or a combination thereof with a hot flue gas and which is shaped to correspond in cross-section to that of the $NO_x$ producing zone targeted by the cooling fluid. Significant $NO_x$ reduction is achieved.

15 Claims, 6 Drawing Sheets

METHOD AND APPARATUS FOR REDUCING NITROGEN OXIDES USING SPATIALLY SELECTIVE COOLING

FIELD OF THE INVENTION

This invention generally relates to a method and apparatus for the reduction of $NO_x$ from the burning of fuels. More specifically the invention relates to a method and apparatus for reducing $NO_x$ from the burning of fuel by the injection of a temperature lowering substance.

BACKGROUND OF THE INVENTION

Techniques for the lowering of oxides of nitrogen ($NO_x$) from gases vented from the burning of fossil fuel are well known. In the U.S. Pat. No. 3,873,671 to Reed et al. a cooling fluid is injected in a boiler to avoid temperatures substantially above 2000 degrees F. The cooling fluid can be a cooled inert gas and water vapor and is injected into the boiler so as to affect all of its volume. U.S. Pat. No. 3,957,420 describes a secondary air staging technique to reduce thermal $NO_x$. Combustion staging with a cooling of combustion gases by way of heat exchange to reduce $NO_x$ is described in U.S Pat. No. 4,989,549 for a cyclone boiler. In U.S. Pat. No. 4,699,071 thermal $NO_x$ is reduced by recycling of furnace gases and mixing this with cool fresh air.

Another low $NO_x$ burner is described in U.S. Pat. No. 5,067,419. In U.S. Pat. Nos. 5,040,470 and 5,259,342 recirculations of flue gases are employed to reduce $NO_x$. In U.S. Pat. No. 5,333,574 flue gas and air exiting a flue gas blower are injected into the combustion chamber to control $NO_x$. Other techniques for controlling the generation of thermal $NO_x$ are described in U.S. Pat. Nos. 5,410,989 and 5,433,174.

Although the prior art cooling techniques reduce $NO_x$ from burners they tend to be cumbersome and complex to implement and reduce efficiency of the burner operation because of the general impact of the injection of cooling for the reduction of thermal $NO_x$.

SUMMARY OF THE INVENTION

In a technique in accordance with the invention significant $NO_x$ reduction is achieved by a spatially selective injection of cooling fluid into a burner. This can be done in accordance with one embodiment of the invention by injecting a fluid such as a higher mass flow of gas, which could include flue gas, air at a lower or ambient temperature or a liquid such as water in such a manner as to reduce the temperature of a predetermined identifiable $NO_x$ producing zone.

For example, in one embodiment in accordance with the invention $NO_x$ producing zones are identified for a particular burner. Cooling fluid injecting devices are then placed at strategic locations either at the burner throat or the entrance for the secondary air or at both sites so at enable the cooling fluid to reach the $NO_x$ producing zones. The cooling fluid can be a stream of liquid or a stream of air and flue gas or cool air, such as ambient air. The injection for these cooling streams is selected so as to assure that the streams will reach and impact the targeted $NO_x$ producing zones.

With a technique in accordance with the invention the amount of cooling fluid introduced into the burner can be limited to that needed to avoid significant $NO_x$ production from the targeted $NO_x$ producing zone. One third the amount of water can be used with the method of the invention to cool specific $NO_x$ producing zones for a cyclone type burner in comparison with a conventional water cooling approach. As a result the efficiency of a burner using the invention is much less affected than in conventional water cooling for reducing thermal $NO_x$.

The targeting of cooling streams at identifiable $NO_x$ producing zones can be applied to all sods of different burners and depends upon the ability to identify these zones and their accessibility with strategically placed injection sites. With this invention a relatively convenient $NO_x$ reduction technique can be implemented and retro-fitted to existing burners.

It is, therefore, an object of the invention to provide a method and apparatus for reducing $NO_x$ from a burner. It is a further object of the invention to provide cooling apparatus and technique for the reduction of $NO_x$ from a burner in an efficient manner. It is further object of the invention to provide a reduction of $NO_x$ in a cyclone type burner by spatially selectively injecting a fluid which is capable of reducing the temperatures of $NO_x$ producing zones.

These and other objects and advantages of the invention can be understood from a description of several embodiments in accordance with the invention as shown in the drawings.

DETAILED DESCRIPTION OF THE DRAWINGS

Figure 1:
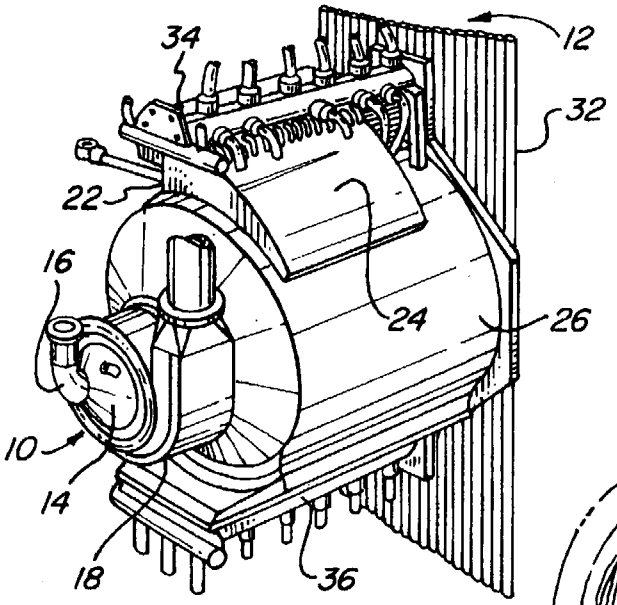
FIG. 1 is a perspective view of a conventional cyclone burner and boiler.
Figure 2:
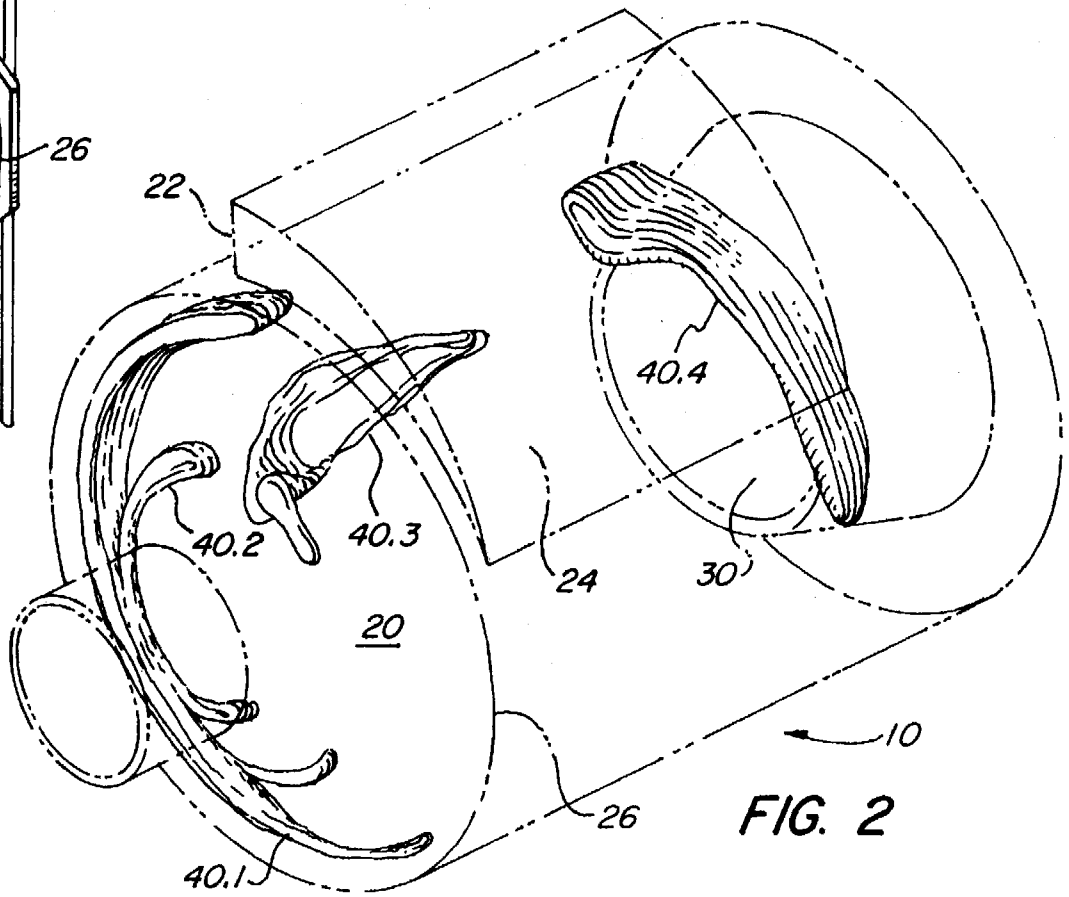
FIG. 2 is a perspective broken away and slightly enlarged view of the cyclone burner of FIG. 1 with $NO_x$ producing zones identified.

With reference to FIGS. 1 and 2 a burner 10 as part of a boiler 12 is shown of the cyclone type. The burner 10 has a primary air and fuel inlet end 14 with a solid fuel (ground coal) line 16 and a primary air inlet 18 which enters a cylindrical combustion chamber 20 tangentially to produce a vortex flow of air around the axially and centrally fed solid fuel. Preheated (usually to about 600 degrees F by way of heat exchange with flue gas as shown at 21 in FIG. 3) secondary air is also supplied tangentially to the chamber 20 through an inlet 22 leading into tangential ducting 24. The ducting 24 gradually merges with the wall 26 of the combustion chamber 20 so as to provide a cyclone combustion zone inside the combustion chamber 20.

The combustion chamber 20 has an outlet 30 which leads into the boiler 12. The boiler has its wall lined with tubes 32 for heat exchange with the heat generated within the burner 10. The combustion chamber 20 is also lined with heat exchange tubes and appropriately connected to headers 34, 36. Slag removal occurs through appropriate traps (not shown) in the bottom of the combustion chamber 20.

Through an analysis of the circulation patterns of the gases inside the burner 10 one can identify high temperature zones where oxygen concentration allows thermal $NO_x$ to be generated. These zones 40.1–40.4 are specific regions where the temperatures are preferably controlled to levels where thermal $NO_x$ production is significantly reduced. The prior art proposes a general inundation of the combustion chamber with a cooling medium such as water to cause an overall reduction in the maximum temperatures. This tends to be wasteful of available energy and thus reduces the efficiency of the burner.

Figure 3:
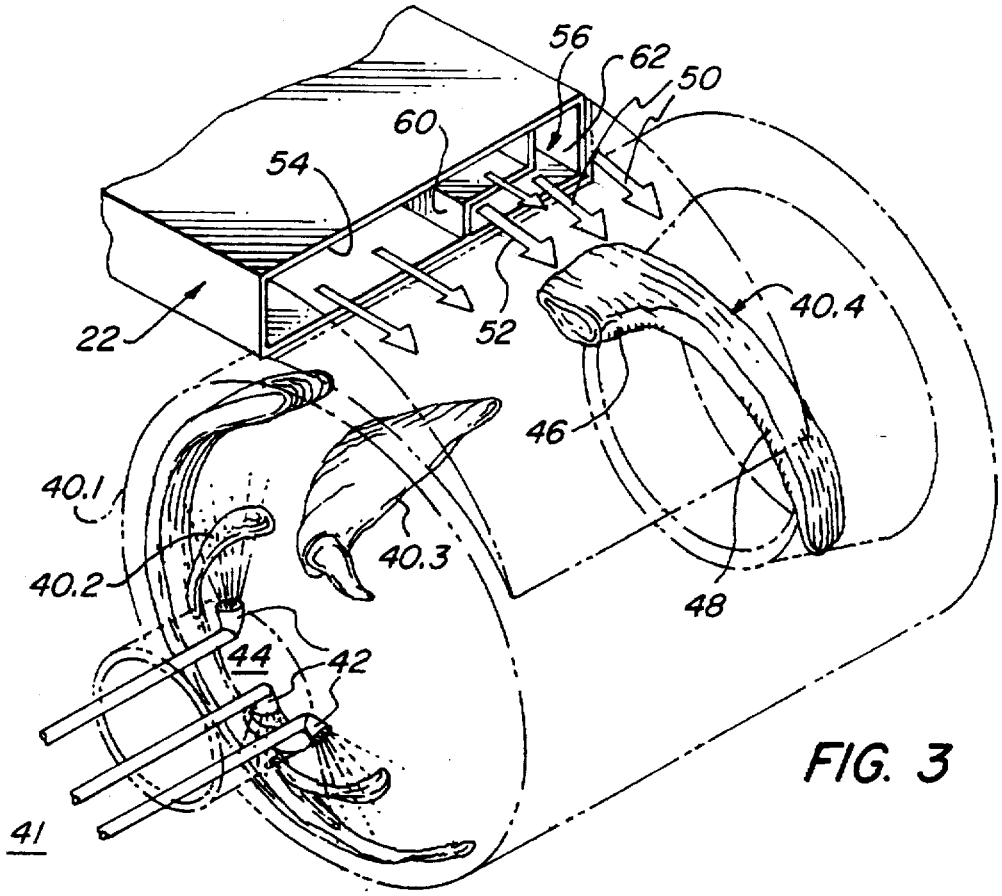
FIG. 3 is a perspective view of the cyclone burner as shown in FIG. 2 with cooling devices for injecting cooling air streams placed at strategic locations of the burner.
Figure 4:
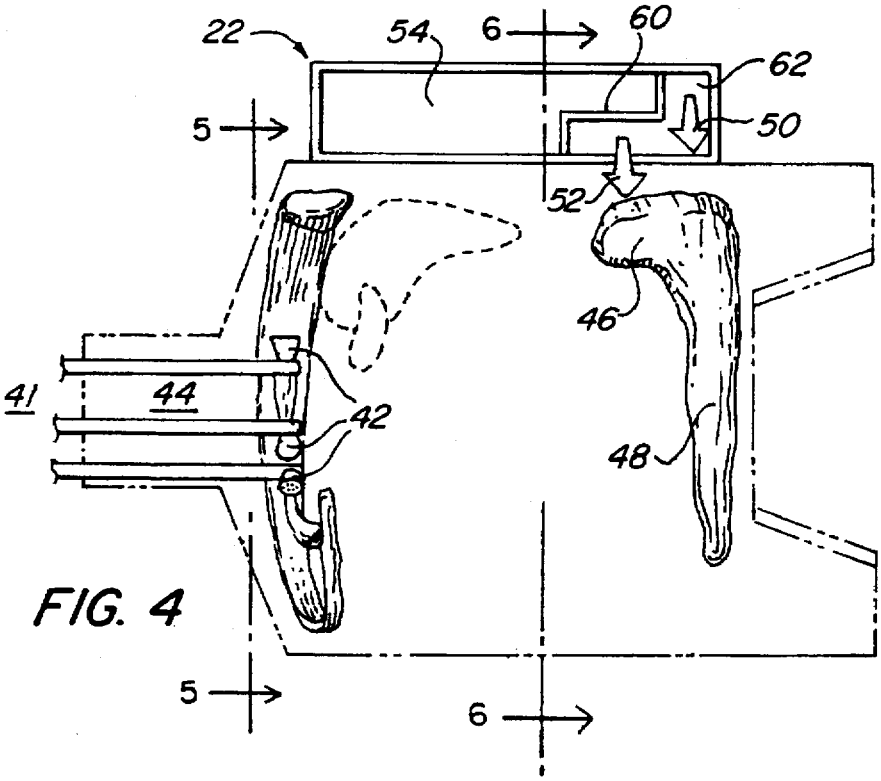
FIG. 4 is a side broken away view in elevation of a cyclone burner as depicted in the view of FIG. 3.
Figure 5:
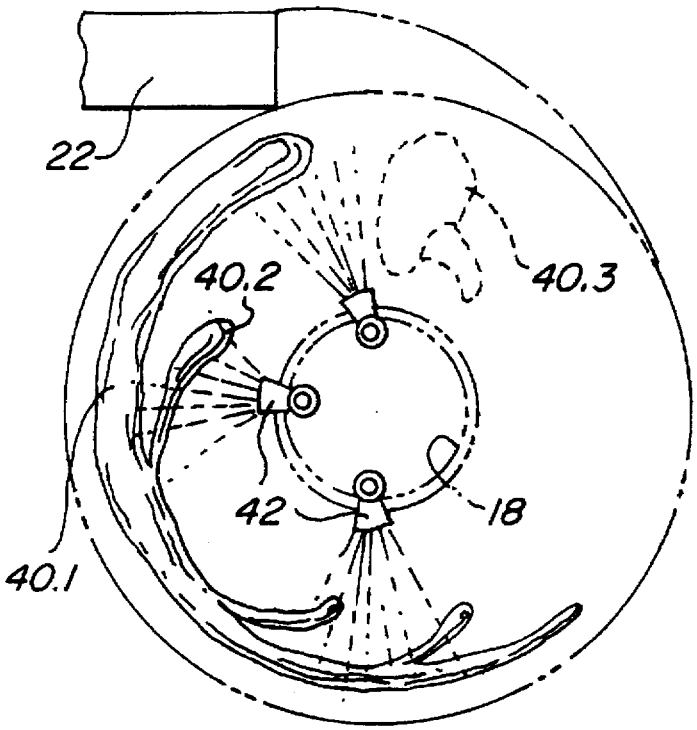
FIG. 5 is a section view of the burner of FIG. 4 taken along the line 5—5 in FIG. 4.
Figure 6:
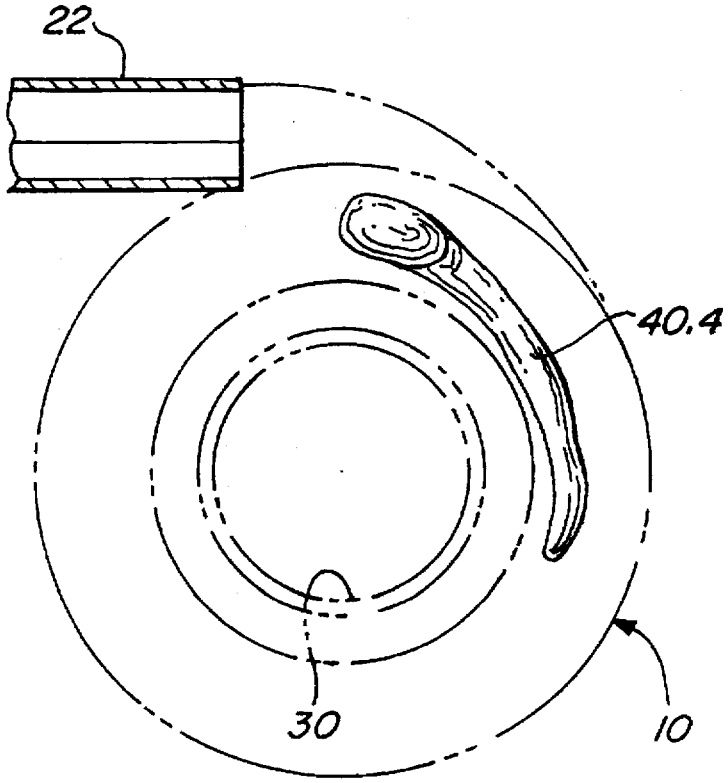
FIG. 6 is a section view of the burner of FIG. 4 taken along the line 6—6 in FIG. 4.

In applicant's invention specific zones 40 can be targeted for temperature reduction with a suitable fluid which can be air or water or other cooling media such as cooled flue gas whose heat has been removed or even hot flue gas injected with sufficient mass flow or non-combustible liquid streams. This is done as illustrated in FIGS. 3 and 4 by directing a cooling medium such as non-preheated secondary air through a separate supply 41 to the zone 40.3 and non-preheated air from nozzles 42 at the burner throat 44 to the zones 40.1 and 40.2. Since the cooling fluids cannot always reach all of the high $NO_x$ zones the temperature of a zone such as 40.4 cannot be specifically targeted in this manner.

The fluid used to cool the $NO_x$ producing zones 40.1–40.3 need not always be the same and can be a mixture of heat absorbing gases or cooling liquids. For example, the $NO_x$ producing zones 40.1 and 40.2 can be treated with water in the form of droplets supplied through nozzles 42 while the $NO_x$ zone 40.3 is treated with a heat absorbing gas which could be a colder temperature gas such as ambient non-preheated air or hot flue gas with additional mass flow. The droplet sizes preferably are so controlled so as to produce a fluid stream sufficient to cool the maximum temperature of the targeted zone to a level that is low enough to prevent significant thermal $NO_x$ production.

The targeting of $NO_x$ producing zones 40 can be adjusted to accommodate their particular shapes. For instance, the $NO_x$ producing zone 40.3 has an axial segment 46 and a curved segment 48. The latter extends circumferentially around the central axis of the burner 10 for some distance. Accordingly the cooling fluid is selected to have a cross-sectional shape that is commensurate with that of the $NO_x$ producing zone 40.3 as seen along the flow direction of the secondary air flow. The amount of cooling fluid supplied to $NO_x$ zone 40.3 is thus selected so that a predominant portion 50 can be entrained along and thus substantially overlap the zone segment 48. The axial segment 46 can be reached with a correspondingly axially extending portion 52 of the cooling ambient secondary air.

One technique for shaping of the cooling fluid is obtained by modifying the impact of the cross-sectional shape of the secondary air. The secondary air inlet 22 is, therefore, partitioned to form a normal preheated secondary air supply duct 54 and a cooling L-shaped secondary air supply duct 56. The duct 56 in turn is shaped to form a smaller cross-section axially extending duct 60 and a larger volume supplying duct 62. The cross-sectional shape of the cooling air supply duct 56 is made to correspond to the cross-sectional shape of the $NO_x$ producing one to be targeted. The shape can thus be changed as may be needed to cool a $NO_x$ producing zone.

Figure 7:
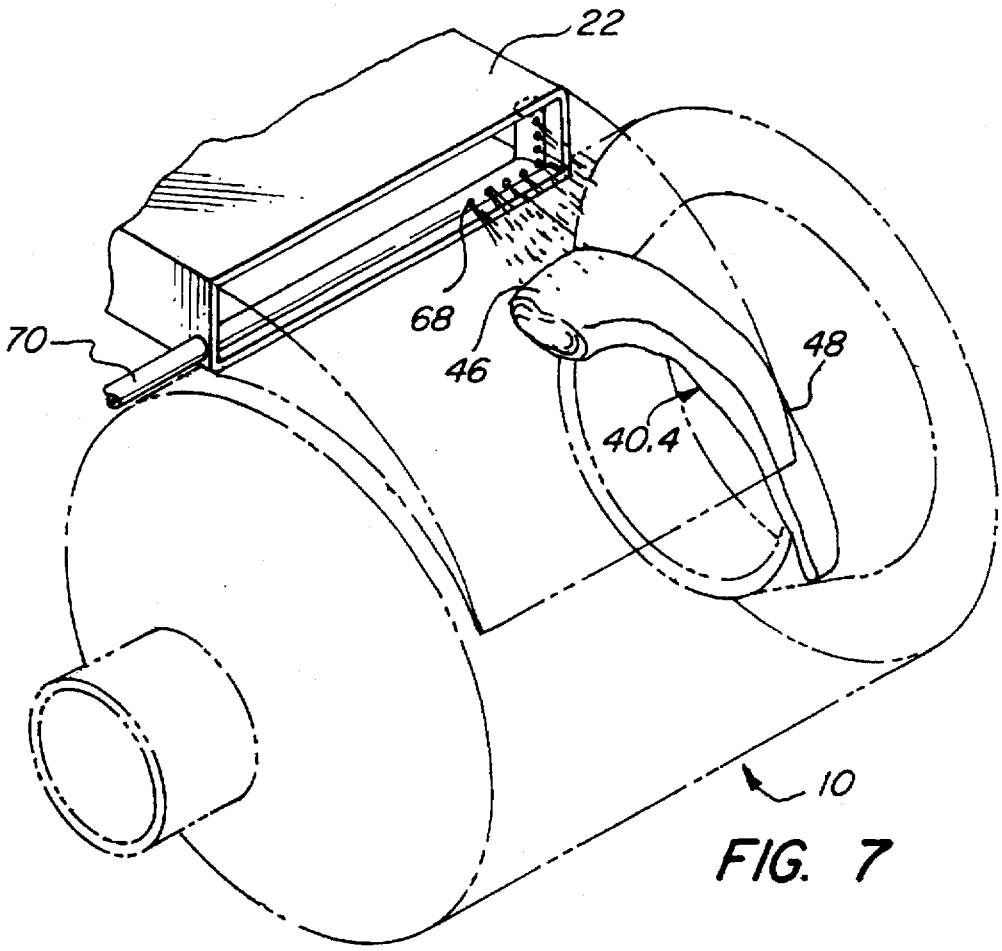
FIG. 7 is a perspective broken away view of the burner as shown in FIG. 1 with a water stream employed at a strategic location to effect a cooling of a targeted $NO_x$ producing zone.
Figure 8:
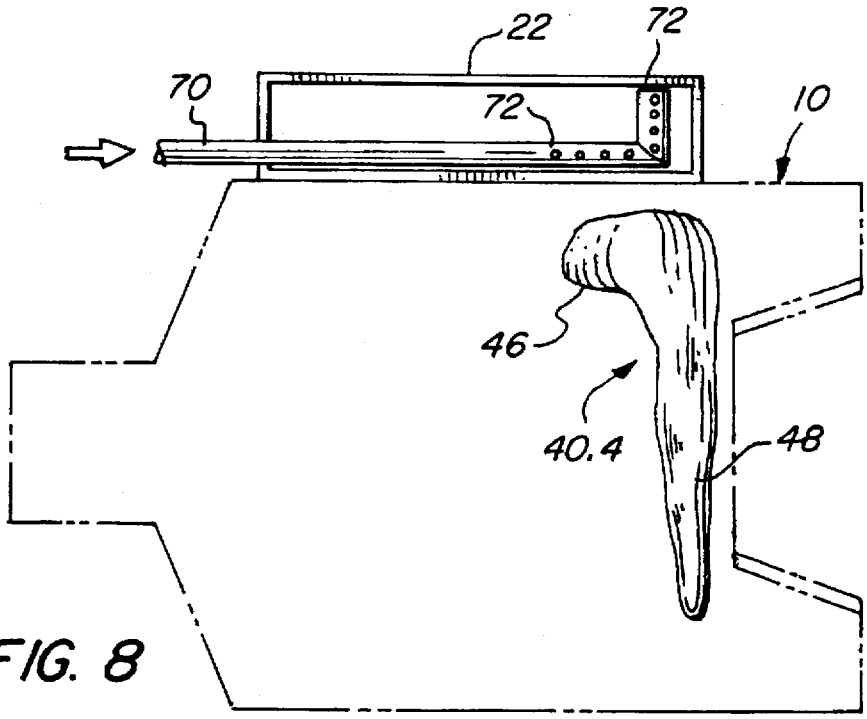
FIG. 8 is a side view in elevation of the burner shown in FIG. 7.

FIGS. 7 and 8 illustrate a technique for cooling the $NO_x$ zone 40.3 by way of an insertion of a well aimed and controlled stream of droplets 68 from a spray bar 70. The spray bar 70 is disposed at or near the discharge end of the secondary air conduit 22. The spray bar 70 has a plurality of orifices 72 from which a liquid such as water with or without special $NO_x$ reducing compounds is introduced in the form of droplets. The amount of water introduced can be controlled with sizing of orifices 72 or with water pressure regulators, not shown, placed in the water supply conduits leading to the spray bars 70.

The stream of liquid is shaped by shaping the end of the bar 70 in such a manner so that the $NO_x$ zone 40.3 can be sufficiently influenced to a reduce its $NO_x$ producing temperature. In the case of $NO_x$ zone 40.3 the bar 70 has its end L-shaped similar to the shaping of the duct 56 in FIG. 3. The sizes of the droplets are made sufficiently small so as to assure that their evaporative cooling effect is placed close to the nearby portion 46 of the $NO_x$ zone 40.3 and yet not too small so as to completely evaporate before reaching the main $NO_x$ producing zone portion 48. The droplets from the bar 70 can be tailored, by sizing of the orifices 72, to fit the geometry of the $NO_x$ zone 40.3, with fine droplets for the nearby zone 46 and coarser droplets for zone 48.

It should be understood, however, that the spatially selective cooling by the secondary airstream can be sufficient to influence a particular $NO_x$ producing zone so that specially sized droplets may not be needed to practice the invention. Combinations of droplets and a cooler secondary airstream can be employed. In another example the cooling fluid can be the injection of an additional mass flow of hot flue gas, i.e. such as the flue gas emerging from the boiler preferably after heat has been removed from the flue gas in its heat exchange with secondary air flow. The flue gas in such case is added as an additional mass flow to the fluid stream incident on the targeted $NO_x$ producing zone.

The use of hot flue gas in cooling of a $NO_x$ producing zone can be justified particularly when the flue gas is injected as an additional mass flow. The higher temperature of the flue gas is not as high as the temperature of the $NO_x$ producing zone and with the additional mass flow on the average can still achieve a cooling of that zone to a low $NO_x$ producing level. The injection of an additional mass flow of flue gas can be done with pressure added by appropriate fans.

With a spatially selective fluid injection system in accordance with the invention substantial $NO_x$ reduction can be achieved. For example, a $NO_x$ reduction of 50% can be achieved by spatially selectively cooling about 40% of the combustion air that was targeted to enter the highest $NO_x$ production zones. In a cyclonic burner as shown in the drawings the spatial zone indicated by segment 56 intersects about 20% of the secondary air. Injecting a controlled amount of water spray into this zone segment 56 can yield a reduction of $NO_x$ by about 30% without significantly affecting temperatures of other regions in the combustion zone.

In practical terms, for a 815,000 lb/hr cyclone fired boiler using coal at a maximum rate of 30,000 lb/hr, the baseline $NO_x$ production is about 1.34 lb/mmBtu. A $NO_x$ reduction of 35% can be achieved when spraying in about 4000 lb/hr of water distributed into the predominant $NO_x$ producing zones 40.1, 40.2 and 40.3 in the manner as taught by the invention. Water droplets in the range from about 50 to about 100 microns preferably are injected by mechanical or two fluid type atomizers. Water distribution should be with about equal amounts injected into the $NO_x$ zone 40.3 and the combination of the $NO_x$ zones 40.1 and 40.2. Temperatures in other regions remain about the same.

Note that the injection of the water sprays creates a heat sink within the airstreams that will absorb heat at the $NO_x$ producing zones. A similar effect can be achieved with other cooling air streams as described herein.

Figure 9:
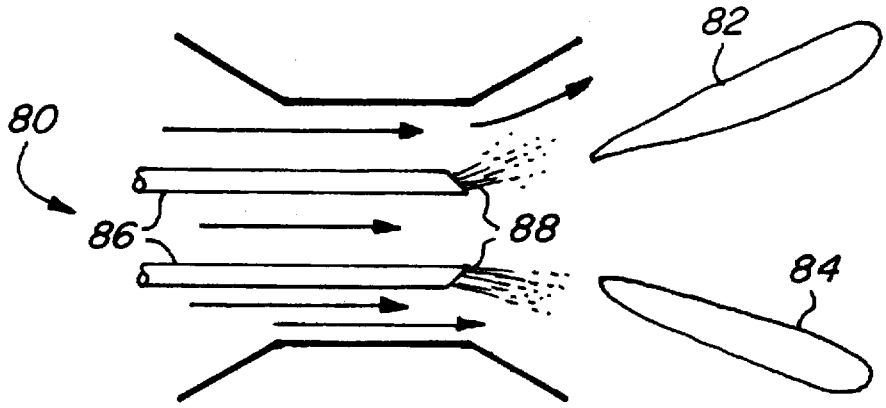
FIG. 9 is a diagrammatic view of a wall burner using the spatially selective cooling of the invention.

FIG. 9 illustrates a wall burner 80 having a conically shaped $NO_x$ producing zone 82. This is spatially selectively cooled with sprays of droplets from well aimed conduits 86 having nozzles 88.

Figure 10:
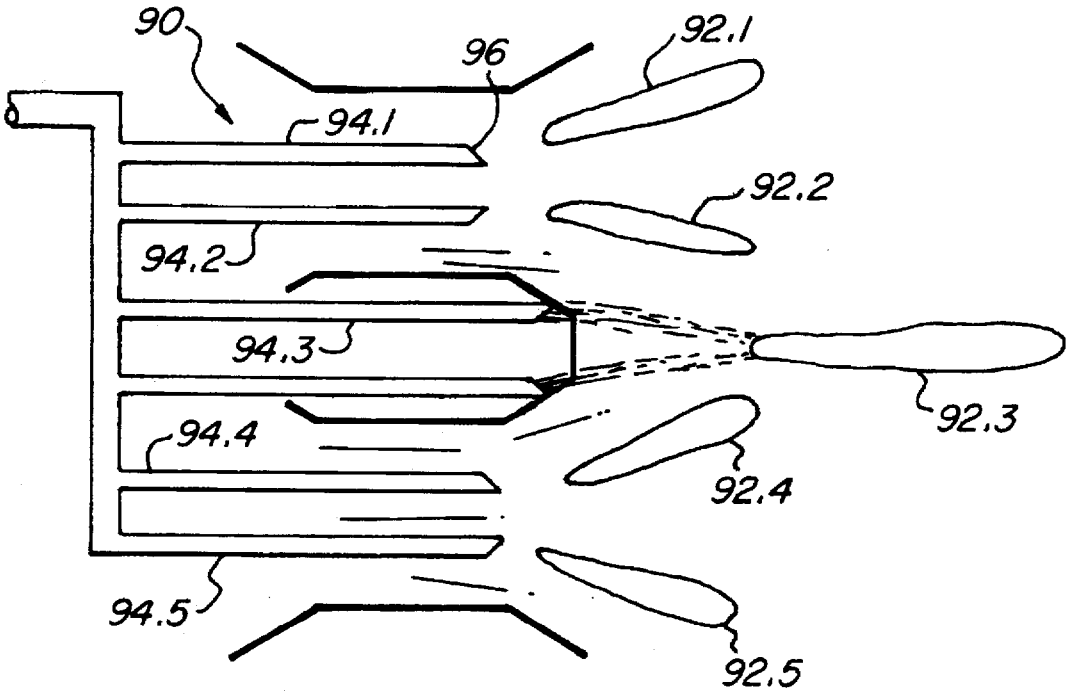
FIG. 10 is a diagrammatic view of another wall burner using the invention.

FIG. 10 shows two closely coupled wall burners 90 with a number of identifiable $NO_x$ producing zones 92.1–92.5 all of which are selectively cooled with streams of cooling fluid from nozzles 94 located at the end of cooling supply conduits 96.

Figure 11:
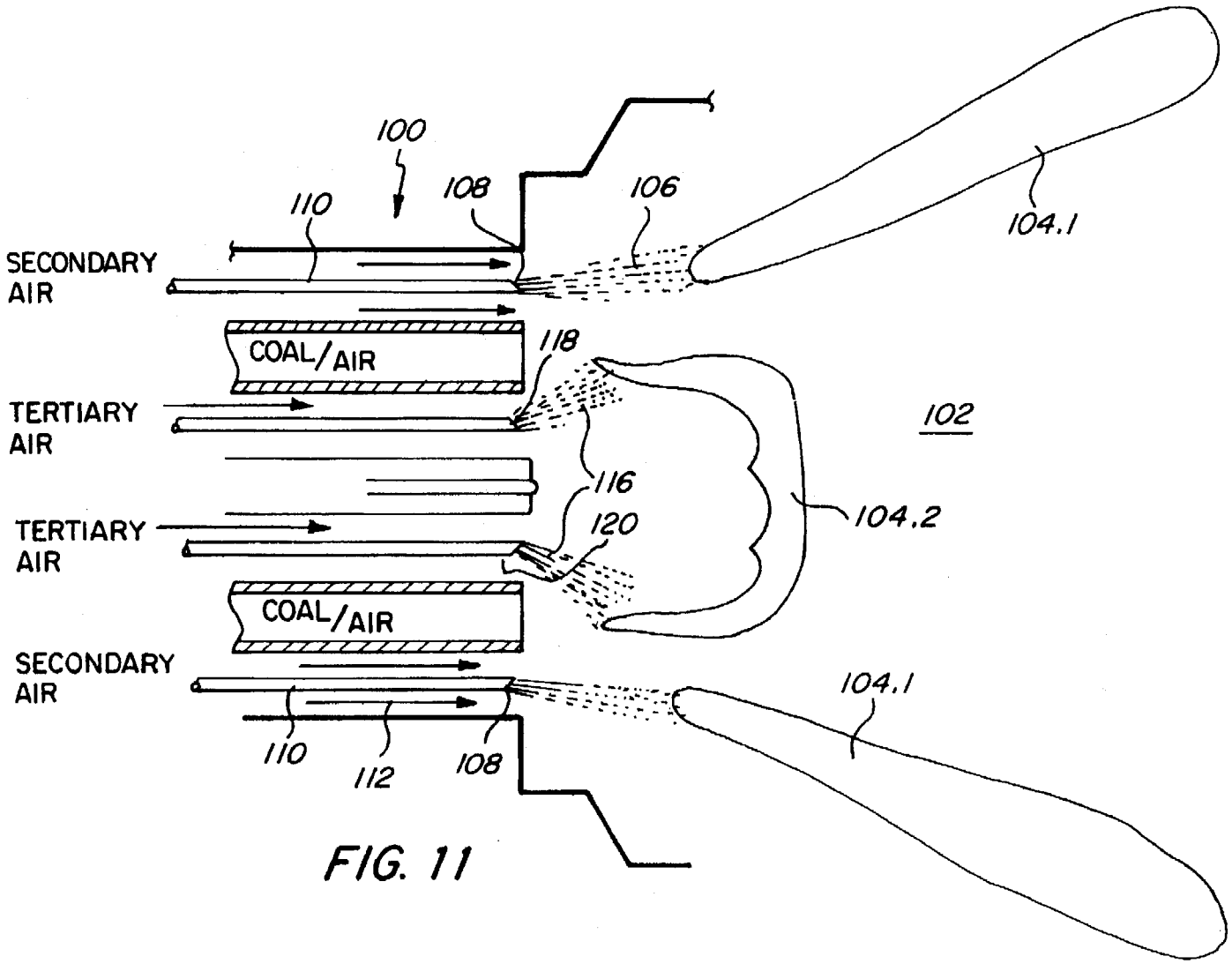
FIG. 11 is a diagrammatic view of a coal burner with a spatially selective cooling device in accordance with the invention.

FIG. 11 shows a coal burner 100 with a combustion region 102 having distinct $NO_x$ producing zones, an annular zone 104.1 and a central zone 104.2. Zone 104.1 is a conically shaped zone which is targeted for selective cooling with an annular shaped spray 106 generated from a correspondingly shaped discharge nozzle 108 at the end of a conduit 110 and placed within the annular shaped secondary air stream 112. Similarly the $NO_x$ producing zone 104.2 is targeted with an annular spray 116 obtained from an annular nozzle 118 located in the annular tertiary air flow 120.

Having thus explained one embodiment of the invention its advantages can be appreciated. One third of the amount of water can be used to reduce thermal $NO_x$ in comparison with conventional techniques using a cooling fluid. Variations can be adopted without departing from the scope of the following claims. The invention can be used with many different burners other than the described and illustrated cyclone burner, which is shown herein to demonstrate the invention. The $NO_x$ producing zones for these other burners may be at different locations and different cooling techniques adopted to influence their temperatures in the spatially selective manner taught by the invention.

What is claimed is:

1. A method for reducing the production of $NO_x$ from a combustion zone fed with a fuel and combustion air which establishes a flow pattern inside the combustion zone resulting in at least one identifiable zone embedded inside the combustion zone where $NO_x$ tends to be produced, comprising the steps of:

producing a spatially distinct stream of cooling fluid at a predetermined location in a portion of the combustion air flow; with said location selected so that the stream of cooling fluid is entrained by the combustion air flow to intersect the embedded identifiable zone inside the combustion zone; and applying said cooling fluid to said predetermined location in an amount sufficient to be entrained by the combustion air flow through a part of the combustion zone and reach the embedded identifiable zone so as to reduce its temperature for a reduction of $NO_x$ generated from said identifiable zone without significantly affecting temperatures of gases in the combustion zone outside said identifiable zone.

2. The method as set forth in claim 1 wherein said cooling fluid comprises a stream of liquid.

3. The method as set forth in claim 2 wherein said cooling fluid comprises a spray of water formed with droplets whose sizes enable the droplets to cool a spatially distinct volume of gaseous mass in the combustion air flow and reach the identifiable zone to cool said zone to lower production of $NO_x$ therein.

4. The method as set forth in claim 1 wherein said stream of cooling fluid comprises a stream formed of gas and liquid.

5. The method as set forth in claim 1 wherein said stream of cooling fluid is formed of a stream of gas at ambient temperature.

6. The method as set forth in claim 1 wherein said stream of cooling fluid is includes a mass flow of flue gas.

7. The method as set forth in claim 6 wherein said stream of cooling fluid is formed of a combination of secondary air and an additional mass flow of flue gas.

8. A method for reducing $NO_x$ produced in a boiler fed with a fuel with primary air flow and preheated secondary air flow with the gases inside the boiler having a flow pattern resulting in at least one identifiable zone which tends to be a $NO_x$ producing zone embedded inside the combustion zone in the boiler, comprising the steps of:

injecting a distinct stream of cooling liquid at a predetermined location in a portion of the preheated secondary air flow so as to produce a spatially distinctive cooled air mass flow within said secondary air flow; and with said location selected so that the cooled air mass flow is entrained by the secondary air flow to intersect said embedded identifiable $NO_x$ producing zone inside the boiler; and applying a sufficient amount of said stream of liquid to said predetermined location so as to significantly reduce the $NO_x$ generated from said identifiable $NO_x$ producing zone without significantly affecting temperatures of gases in the combustion zone outside said identifiable NOx producing zone.

9. The method as set forth in claim 8 wherein said injecting step comprises injecting said distinct liquid stream into a predetermined portion of a secondary air inlet leading into a cyclone boiler.

10. The method as set forth in claim 9 and further comprising the step of injecting a stream of liquid into a region of the cyclone boiler located in the vicinity of the burner so as to produce a spatially distinct cooled gaseous stream which intersects an identifiable $NO_x$ producing zone located in front of said burner and inside the boiler.

11. An apparatus for reducing the production of $NO_x$ from a combustion zone fed with a fuel and combustion air causing a flow pattern inside the combustion zone with at least one identifiable zone which tends to be a $NO_x$ producing zone, comprising:

means for producing a stream of cooling fluid at a predetermined location in a portion of the combustion air flow; with said location selected so that the stream of cooling fluid is entrained by said combustion air flow to intersect said identifiable zone; and means for controlling said stream of cooling fluid so as to produce a spatially distinct cooled mass flow in said combustion air flow to sufficiently lower the temperature of the identifiable zone to significantly reduce $NO_x$ produced therein without significantly affecting temperatures of gases in the combustion zone outside said identifiable zone.

12. The apparatus as set forth in claim 11 wherein said controlling means comprises a duct interposed in the combustion air flow and having a cross-sectional shape commensurate with that of the embedded identifiable zone as viewed in the direction of the flow of said combustion air, with said cooling fluid stream being supplied into said duct.

13. The apparatus as set forth in claim 11 wherein said apparatus includes a primary air flow and a secondary air flow and wherein said shaping means comprises a duct interposed in the secondary air flow and having a cross-sectional shape commensurate with that of the identifiable zone and wherein said cooling fluid producing means injects said cooling fluid in said controlling means.

14. The apparatus as claimed in claim 13 wherein said means for producing cooling fluid comprises means for supplying a distinct stream of gas having a lower temperature than preheated secondary air to said duct.

15. The apparatus as claimed in claim 14 wherein said gas supplying means comprises means for supplying ambient air into said duct.

* * * * *